US006865847B2

(12) United States Patent
Fraser et al.

(10) Patent No.: US 6,865,847 B2
(45) Date of Patent: Mar. 15, 2005

(54) SHUTTER LOUVER BRAKE

(75) Inventors: Donald E. Fraser, Owensboro, KY (US); Richard N. Anderson, Whitesville, KY (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 0 days.

(21) Appl. No.: 10/648,116

(22) Filed: Aug. 26, 2003

(65) Prior Publication Data

US 2004/0045220 A1 Mar. 11, 2004

Related U.S. Application Data

(60) Provisional application No. 60/408,320, filed on Sep. 5, 2002.

(51) Int. Cl.[7] ..... E06B 7/086
(52) U.S. Cl. ..... 49/90.1; 49/89.1
(58) Field of Search ..... 49/74.1, 90.1, 49/89.1, 403, 371, 87.1; 160/104, 174 R

(56) References Cited

U.S. PATENT DOCUMENTS 48,116 A * 6/1865 Wagenen ..... 49/90.1
210,015 A * 11/1878 Cruse et al. ..... 49/87.1
479,398 A * 7/1892 Buhmeier ..... 49/80.1
535,871 A * 3/1895 Taylor ..... 49/403
921,854 A * 5/1909 Lindemann ..... 49/74.1
2,759,410 A * 8/1956 Hurt, Jr. ..... 454/319
3,180,246 A * 4/1965 Johnson ..... 454/319
3,375,608 A * 4/1968 Thompson ..... 49/403
3,905,284 A * 9/1975 Busse et al. ..... 454/320
4,509,290 A * 4/1985 Stanfield, Jr. ..... 49/91.1
4,936,048 A 6/1990 Ruggles
5,469,658 A 11/1995 Digianni et al.
5,630,295 A * 5/1997 Neiman ..... 49/403
5,778,598 A * 7/1998 Ohanesian ..... 49/74.1
5,921,028 A 7/1999 Marocco
6,655,091 B1 * 12/2003 Iwasaki ..... 49/403

* cited by examiner

*Primary Examiner*—Gregory J. Strimbu
(74) *Attorney, Agent, or Firm*—Camoriano and Associates; Theresa Fritz Camoriano; Guillermo Camoriano

(57) ABSTRACT

A louver braking mechanism for use in shutters, used to hold the louvers in place against the moment arm resulting from the weight of the tilt bar urging the louvers to close. The disclosed mechanisms provide a frictional resistance to the louver pivotal movement, which must be overcome by the user in order to reposition the louvers. In a preferred embodiment, the frictional resistance increases as the louver begins to pivot.

12 Claims, 7 Drawing Sheets

SHUTTER LOUVER BRAKE

BACKGROUND OF THE INVENTION

This application claims priority from U.S. Provisional patent application Ser. No. 60/408,320, filed Sep. 5, 2002. The present invention relates to shutters, and, in particular, to a brake for stopping the louvers of the shutters in a given position.

Shutters are designed to fit over architectural openings such as windows. The shutters generally include slats or louvers pivotably mounted on a frame. The frame is typically comprised of top and bottom horizontal cross rails, and vertically-oriented stiles. A tilt bar is attached to the louvers in order to effect the opening or a closing of the louvers of the shutter. However, the weight of the tilt bar and its mounting location on the louvers create a moment arm which tends to urge the louvers to pivot toward the closed position. Several methods have been tried in the prior art to resolve this undesirable closing tendency.

SUMMARY OF THE INVENTION

A primary objective of the present invention is to provide an improved shutter design, wherein the components allow the louvers to remain in the desired position determined by the user, while allowing an infinite range of positions of the louvers and ease in attaining the desired position. Another objective is to provide an improved shutter design which allows the louvers to remain in the desired position even for shutters which use hole strips for mounting of the louvers.

Some examples of preferred embodiments described herein depict the use of a brake band or spring having a frictional fit around a sleeve which is, in turn, positively engaged to a louver mounting pin. The brake band or spring holds the louver in place by virtue of friction. The user overcomes this friction to move the louvers to the desired position, and the friction then holds the louver in the new position.

Figure 13:
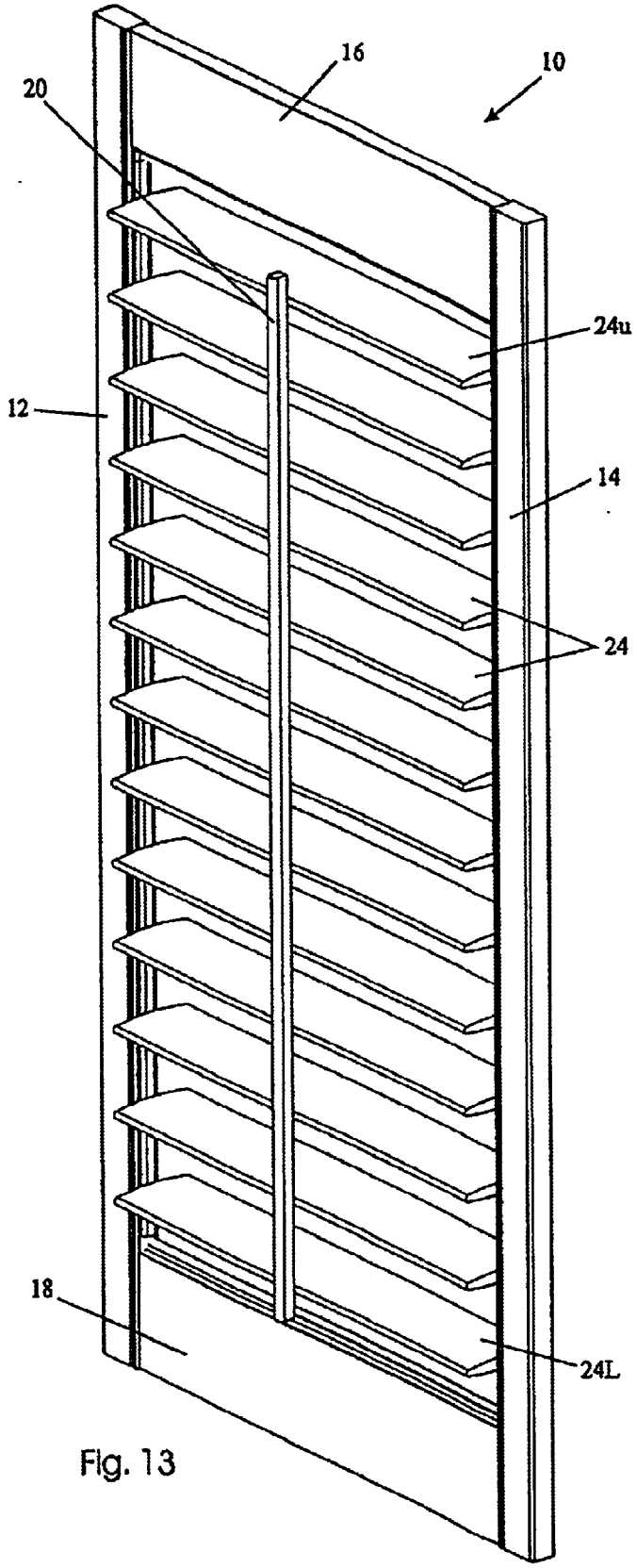
FIG. 13 is a perspective view of a shutter manufactured in accordance with the present invention.
Figure 14:
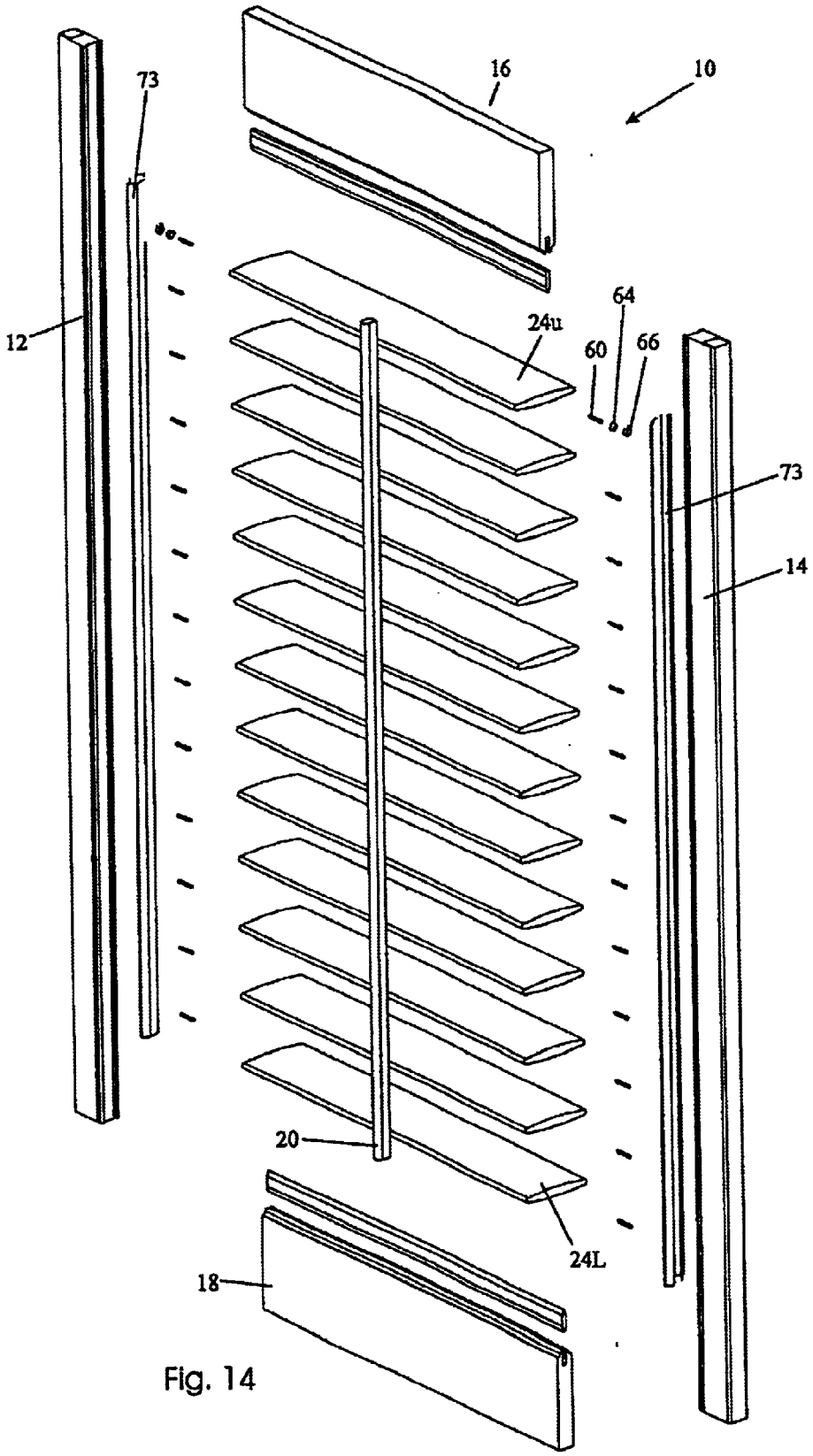
FIG. 14 is an exploded view of the shutter of FIG. 13.

DESCRIPTION OF THE PREFERRED EMBODIMENTS:

FIGS. 13 and 14 show a shutter 10 made in accordance with the present invention. The shutter 10 includes left and right vertical styles 12, 14, upper and lower horizontal cross rails 16, 18, and a plurality of louvers 24, including an uppermost louver 24U and a lowermost louver 24L. The styles 12, 14 and the cross rails 16, 18 form a substantially rectangular frame, which defines an inner perimeter, and it is within this inner perimeter of the frame that the louvers 24 are located, pivotably attached to the styles 12, 14. A tilt bar 20 is pivotably attached to the louvers 24 so that the louvers 24 may be tilted open or closed. The weight of the tilt bar 20 and its attachment point at the edge of the louvers 24 form a moment arm which biases the louvers 24 toward the closed position.

Figure 6:
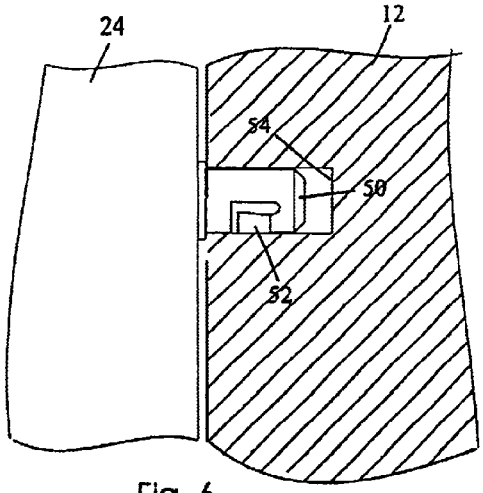
Fig. 6 Prior Art
FIG. 6 is a broken-away section view of the assembled stile and louver of FIG. 4.
Figure 7:
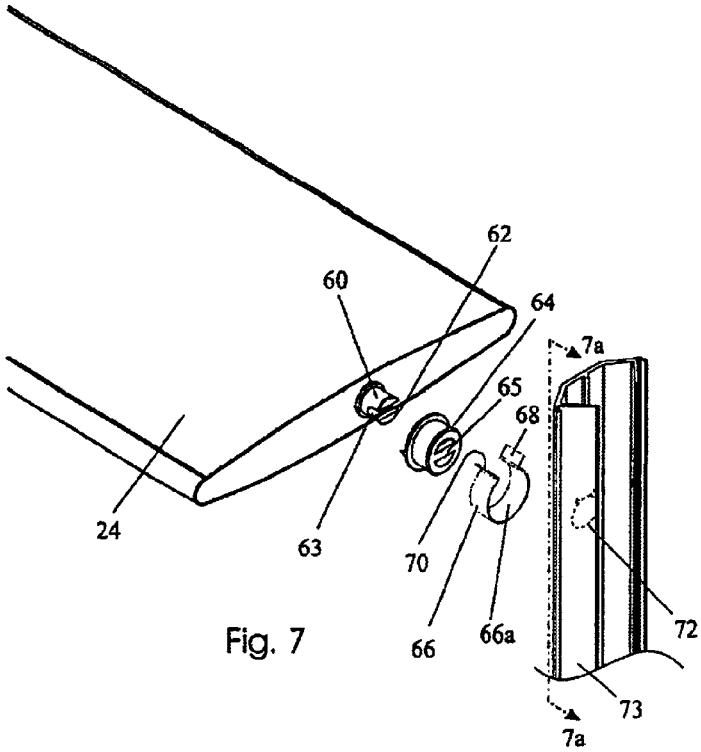
FIG. 7 is an exploded, perspective view of a band brake mechanism made in accordance with the present invention.
Figure 8:
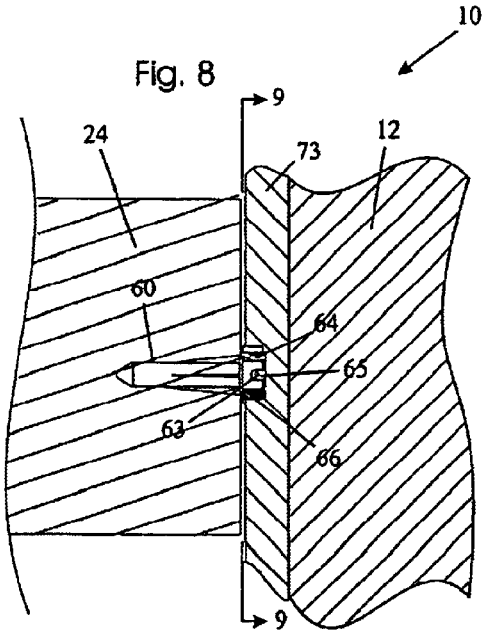
FIG. 8 is a broken-away section view of the stile and louver of FIG. 7.
Figure 9:
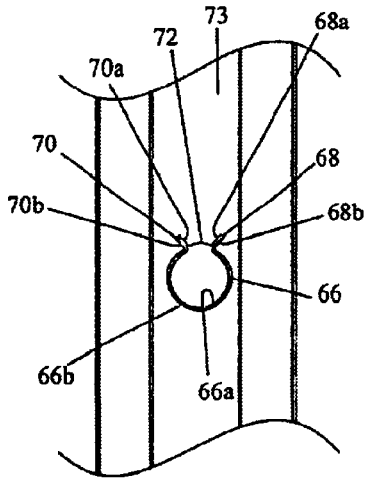
FIG. 9 is an enlarged, broken away view taken along the line 9—9 of FIG. 8, with the louver pin removed.
Figure 10:
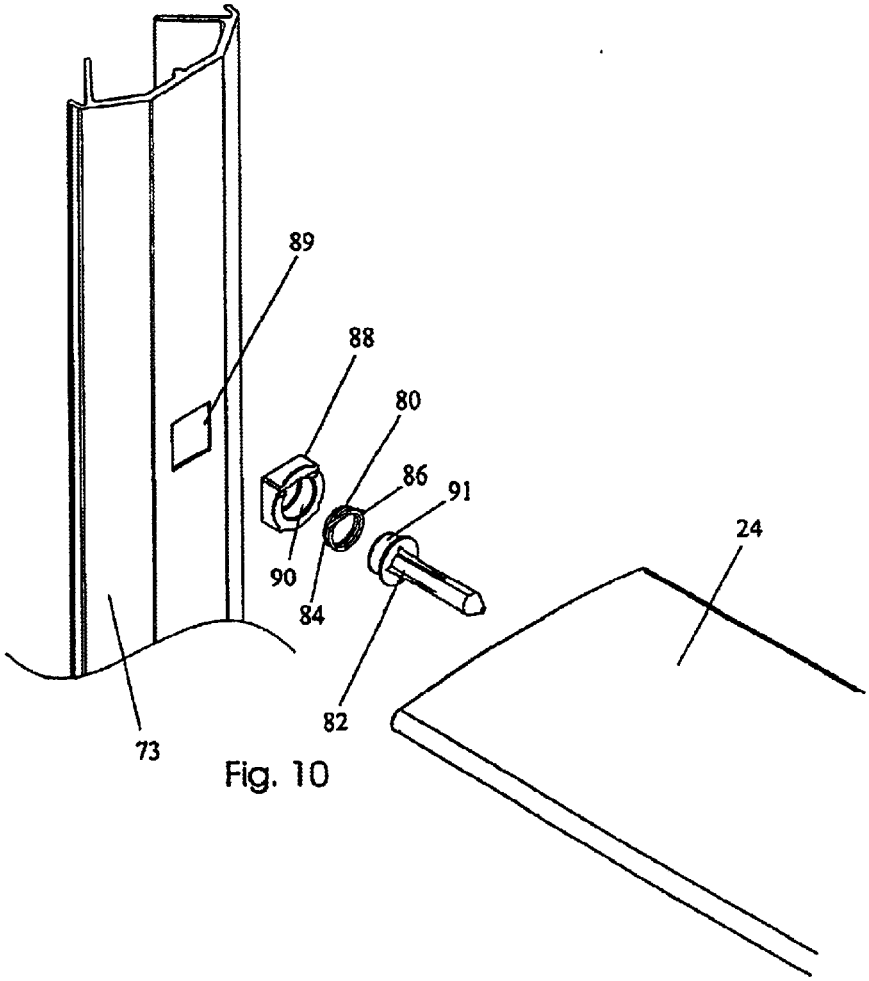
FIG. 10 is an exploded, perspective view of a coil spring mechanism to hold the louvers in place, in accordance with the present invention.
Figure 11:
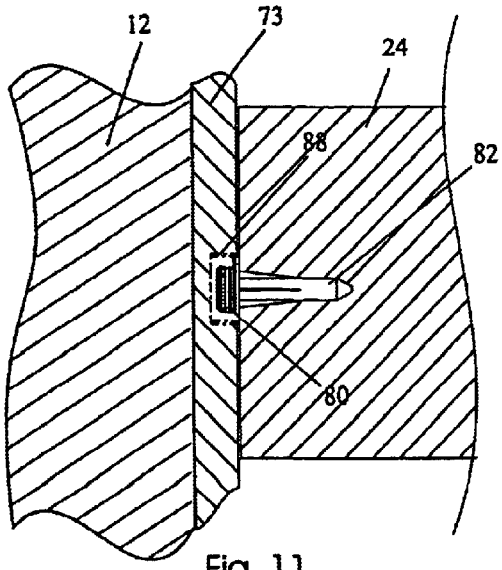
FIG. 11 is a broken-away section view of the assembled stile and louver of FIG. 10.
Figure 12:
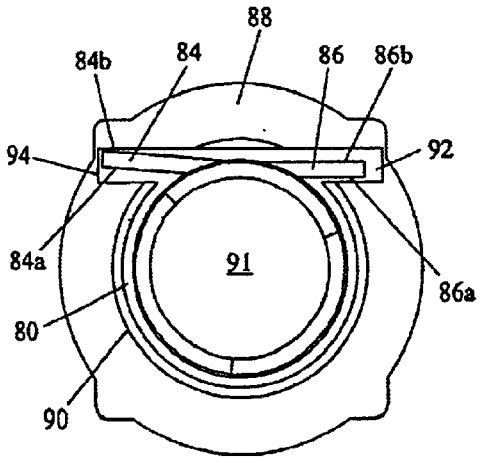
FIG. 12 is an enlarged end view of the coil spring and pocket of FIG. 10.

In accordance with the present invention, the shutter 10 of FIGS. 13 and 14 may use a louver pin arrangement as shown in FIGS. 7–9, an alternative louver pin arrangement as shown in FIGS. 10–12, or some other similar louver pin arrangement. FIGS. 1–6 show some prior art louver pin arrangements. While most of the drawings show only the louver pin at one end of a louver 24, it is understood, as shown in FIG. 14, that there are louver pins at both ends of each louver 24.

Figure 1:
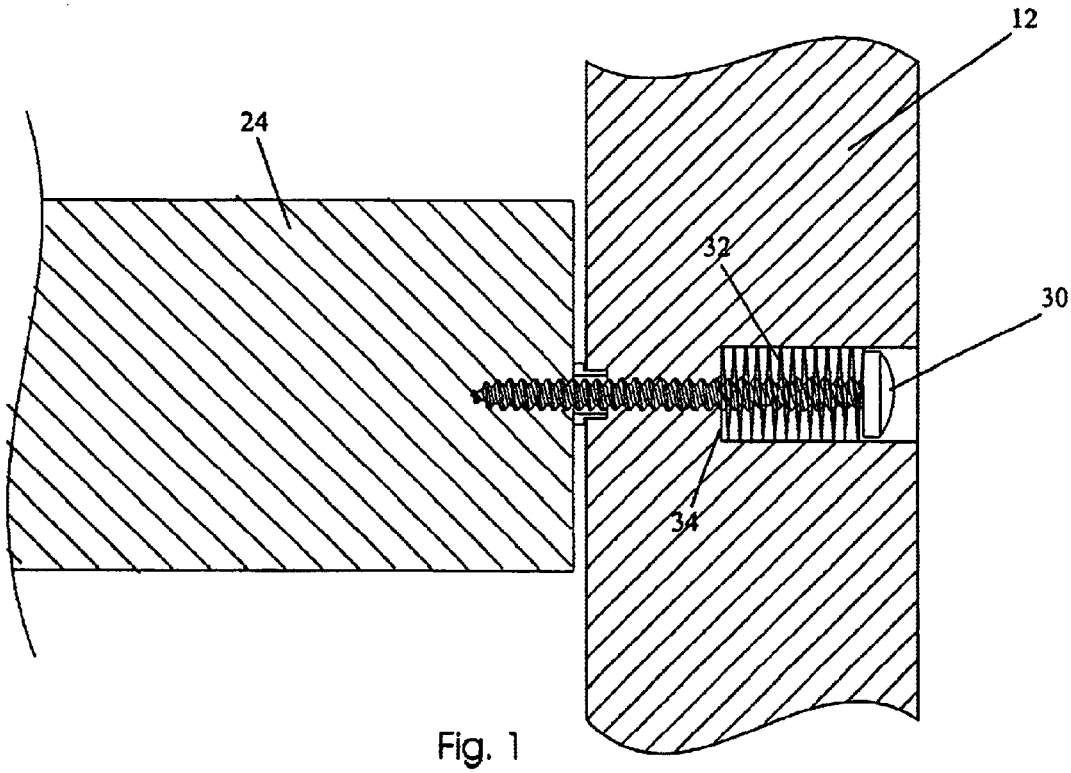
Fig. 1 Prior Art
FIG. 1 is a broken-away view, partially in section, of a tension screw assembly used in the prior art to hold the louvers in position relative to the stile.

FIG. 1 shows a prior art tension screw assembly mechanism for holding the louver 24 in the desired position. A countersunk screw 30 goes through the stile 12 and into the end of the louver 24 at the pivot axis of the louver 24. A spring 32, axially aligned with the screw 30, is wrapped around the screw and pushes against the head of the screw 30 and against the counterbored hole in the stile 12. As the louver 24 pivots open or closed, the screw 30 also pivots with the louver 24. The spring 32 pushes the louver pin or screw 30 outwardly along the pivot axis. This provides a frictional force, between the screw 30 and the stile 12, which acts against the rotation of the louver 24. If the louvers 24 are too loose, such that they tend to rotate closed due to the moment arm of the weight of the tilt bar 20 acting on the louvers 24, then the screw 30 can be screwed further into the louver 24, compressing the spring 32 and thus increasing the frictional force acting against the rotation of the louvers 24. This tension screw mechanism provides an infinite range of adjustment of the position of the louvers 24, but it is not readily adaptable for use in a shutter 10 having a hole strip for mounting the louvers 24 to the shutter 10.

Figure 2:
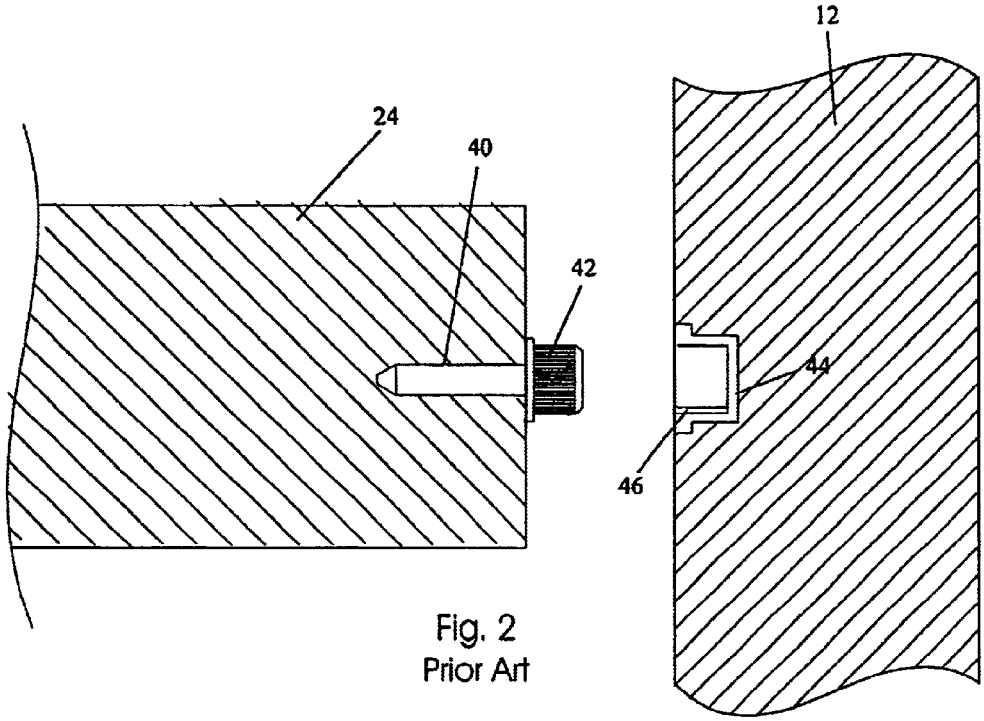
Fig. 2 Prior Art
FIG. 2 is a broken-away, schematic, partially exploded section view of a ratchet or ribbed pin assembly used in the prior art to hold the louvers in position relative to the stile.
Figure 3:
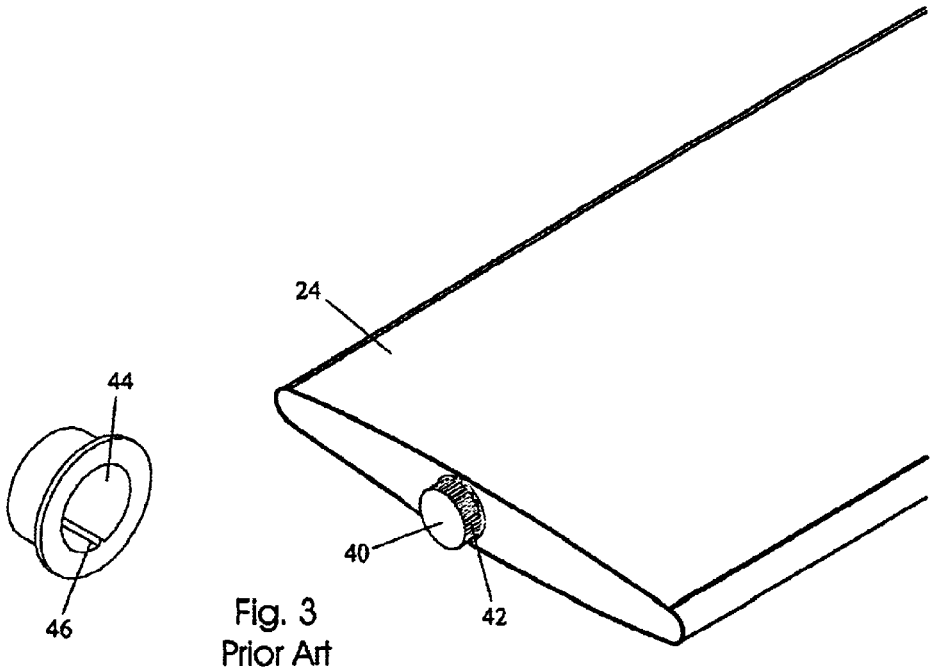
Fig. 3 Prior Art
FIG. 3 is an exploded, perspective view of the ratchet or ribbed pin assembly of FIG. 2 (with the stile omitted for clarity)

FIGS. 2 and 3 show a prior art ratchet or ribbed pin mechanism for holding the louver 24 in the desired position. A ribbed mounting pin 40 is located at the axis of rotation of the louver 24. The head 42 of the pin 40 has a plurality of ribs. This head 42 fits into a mating pocket 44 having a single mating rib 46. The pocket 44 mounts in the stile 12, with the single rib 46 of the pin 40 located at the bottom of the pocket 44. The weight of the louver 24 presses the head 42 with the plurality of ribs against the single rib 46 of the pocket 44, and the single, upwardly projecting rib 46 in the pocket 44 fits between two of the ribs on the head 42, preventing any unwanted rotation of the louvers 24, as may be caused by the moment arm of the weight of the tilt bar 20 acting on the louvers 24. To rotate the louvers 24, the user simply overcomes the mating action of the single rib 46 against the plurality of ribs, causing them to skip over each other. This ribbed pin mechanism has the disadvantage that the louvers 24 can only move in discreet quantities of angular displacement, limited by the number of ribs on the head 42 of the mounting pin 40. Furthermore, operation by the user results in wear of the ribs, until eventually the mechanism can no longer prevent the unwanted rotation of the louvers 24.

Figure 4:
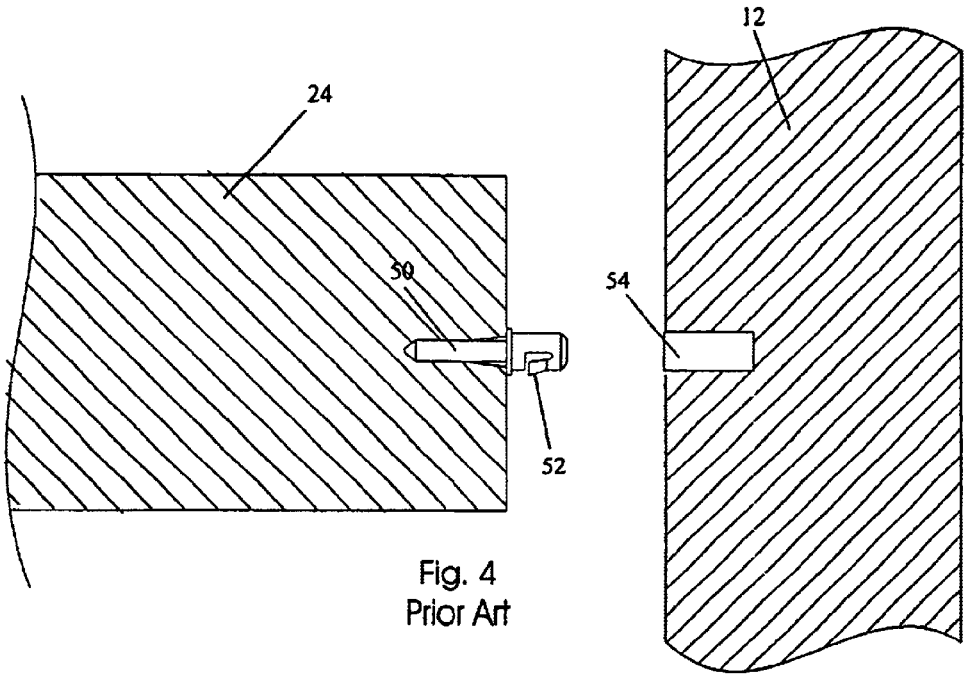
Fig. 4 Prior Art
FIG. 4 is a schematic broken-away section view of a compression leg louver pin assembly used in the prior art to hold the louvers in position relative to the stile.
Figure 5:
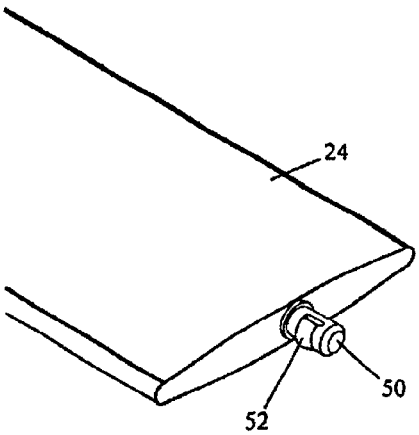
Fig. 5 Prior Art
FIG. 5 is a perspective view of the louver and compression leg pin of FIG. 4.

FIGS. 4, 5, and 6 show a prior art compression leg louver pin mechanism for holding the louver 24 in the desired position. A mounting pin 50 is located at the axis of rotation of the louver 24. The head of the pin 50 has a projecting compression leg 52. This compression leg 52 fits with an interference fit into a mating hole 54 in the stile 12. As the louver 24 is rotated, the compression leg 52 pushes radially outwardly against the inside of the hole 54, in a direction that is substantially perpendicular to the axis of rotation, and provides a frictional resistance to the rotation—a resistance which must be overcome by the user. Operation by the user results in wear of both the compression leg 52 and the mating hole 54 until eventually the mechanism can no longer prevent the unwanted rotation of the louvers 24.

FIGS. 7 through 9 show a band brake mechanism for holding the louvers 24 in place, made in accordance with the present invention. Referring to FIGS. 7 and 13, the louver 24 is mounted to the stiles 12, 14 via louver pins 60, located at the pivot axis of the louver 24. Each louver pin 60 has a split end 62, defining a groove 63 (similar to the groove on screw for use with a flat head screwdriver). The louver pin 60 rotates with the louver 24. A sleeve 64 fits over the end of the pin 60 and includes a web 65, which engages the groove 63 of the pin 60 such that, when the louver 24 rotates, the pin 60 and the sleeve 64 rotate as well, so the pin 60 is effectively made in two pieces in this design. Of course, the sleeve 64 could be made as an integral part of the pin 60, as well.

Figure 7A:
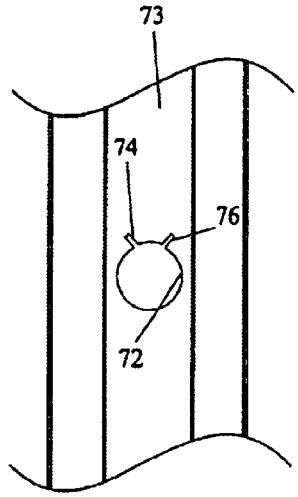
FIG. 7A is a view along line 7A—7A of FIG. 7.

An arcuate brake band 66, having a substantially Ω (omega) shape, clamps around the sleeve 64 with a frictional fit. The brake band 66 applies force to the sleeve 64 in a radially inward direction. The brake band 66 wraps more than 180 degrees around the sleeve, and preferably more than 270 degrees, and is made from a flexible material which allows the band brake 66 to be sprung open to slide over the sleeve 64. The open ends of the band brake terminate in outwardly-projecting wings 68, 70 (See FIGS. 7 and 9). The brake band 66 defines an inside surface 66*a*, and the inside surface portions of the wings 68, 70 are further labeled as 68*a*, 70*a*. The outside surface of the brake band is labeled 66*b*, and outside surfaces of the wings 68, 70 are labeled as 68*b*, 70*b*, respectively. Hole strips 73 are mounted on the inner surfaces of the stiles 12, 13. A routed hole 72 on the hole strip 73 (or directly on the stiles 12, 14 if no hole strip 73 is used) has the same profile as the winged brake band 66, with corresponding wing receptacles 74, 76 (See FIG. 7A) to receive the wings 68, 70 of the brake band 66, such that the brake band 66 fits into this routed hole 72, and there is only a very small amount of free play between the wings 68, 70 on the brake band 66 and the wing receptacles 74, 76 of the routed hole 72.

The louvers 24 are installed onto the shutter 10 as shown in FIG. 8, with the sleeve 64 engaging the mounting pin 60 and the band 66 clamping around the sleeve 64 and engaging the routed hole 72 in the hole strip 73. As the louver 24 is rotated by the user, (for instance a counter-clockwise rotation as seen from FIGS. 7A and 9A), the brake band 66 begins to rotate with the pin 60 and sleeve 64. However, the outside surface 70*b* of the second end 70 of the brake band 66 immediately impacts the side of the wing receptacle 74 of the hole strip 73, stopping the second end 70 of the brake band 66, while the first end 68 continues rotating with the pin 60 and sleeve 64. This causes the first and second ends 68, 70 of the brake band 66 to come closer together, slightly reducing the diameter of the brake band 66, so that it clamps more tightly onto the sleeve 64, thereby increasing the resistance to rotation of the louver 24.

As the user continues to rotate the louver 24 in a counter-clockwise direction, the first end 68 of the brake band 66 continues to travel along with the pin 60 and sleeve 64 until the inside surface 68*a* of the first end 68 of the brake band 66 impacts on the wing receptacle portion 76 of the hole strip 73. At this point, the first wing 68 also stops rotating; the frictional force between the brake band 66 and the sleeve 64 reaches its maximum and thus stops increasing, and the user may continue to rotate the louver 24 in the counter-clockwise direction by overcoming this higher level of frictional resistance. The angular displacement of the brake band 66 from the time the outside surface of the second wing 70 impacts its wing receptacle 74 until the inside surface of the first wing 68 impacts its respective wing receptacle 76 is so small as to be almost undetectable by the user operating the louvers 24.

As soon as the user releases the louver 24 (or the tilt rod 20), the wings 68, 70 of the brake band 66 are no longer pressing against the corresponding wing receptacles 74, 76 of the routed hole 72, and the frictional resistance between the brake band 66 and the sleeve 64 goes back to its original level, which should be sufficient to keep the louvers 24 in place. However, should the moment arm, due to the weight of the tilt rod 20 at its connection point to the louver 24, act so as to begin closing the louvers 24, the same reaction as was described above will occur. Namely, the outside surface 70*b* of the second wing 70 of the brake band 66 will impact against the wing receptacle 74 as the first wing 68 continues rotating, thereby causing the brake band 66 to clamp onto the sleeve 64, with a resulting increase in the frictional resistance between the brake band 66 and the sleeve 64, which counters the unwanted rotation of the louvers 24.

For rotation in the clockwise direction, the effect is similar. First, the outer surface 68*b* of the first wing 68 contacts the side of its receptacle 76, stopping the rotation of that end of the brake band 66 while the second end 70 continues rotating with the pin 60 and sleeve 64. This causes the diameter of the brake band 66 to decrease, thereby increasing the friction between the brake band 66 and the sleeve 64 until it reaches its maximum point, where the second wing 70 contacts its receptacle 74.

FIGS. 10, 11, and 12 depict a second embodiment of a mechanism to hold the louvers 24 in place, in accordance with the present invention. The concept is similar to the band brake mechanism described above, with the main difference being that the simple band brake of the previous embodiment is replaced by a coil spring 80, which is another form of a band brake. This coil spring 80 also applies force to the louver pin 82 in a radially inward direction. The louver pin 82 at the pivot axis of the louver 24 may, in fact, be identical to the split end pin 60 of the band brake mechanism. The sleeve 64 that is present in the band brake mechanism is not shown in this preferred version of the second embodiment, but it may be used if so desired.

Referring to FIG. 12, the coil spring 80 has two outwardly-projecting free ends 84, 86, defining corresponding inside surfaces 84*a*, 86*a* and outside surfaces 84*b*, 86*b*. The spring 80 is mounted onto the louver pin 82 by pressing the two ends 84, 86 together, which opens the spring slightly, enough to allow it to slip onto the head 91 of the louver pin 82. Releasing the spring 80 allows it to tighten around the head 91 of the louver pin 82.

A non-circular cross-section pocket 88 is fitted into a corresponding non-circular cross-section hole 89 in the hole strip 73 (or directly into a hole in the stile, if no hole strip is used) such that the pocket 90 is held against rotational motion relative to the hole strip 73. The pocket 88 has a recessed opening 90 shaped and sized to receive the coil spring 80 and louver pin 82 assembly, and this opening 90 defines opposed receptacles 92, 94 (See FIG. 12) which receive the ends 84, 86 of the coiled spring 80. (While this pocket 88 is made as a separate piece that is inserted into the hole strip 73, as an alternative, it could simply be machined into the stile or strip.) The clearance between the ends 84, 86 of the spring 80 and the receptacles 92, 94 of the pocket 88 are very small, in order to allow only a very slight rotation of the spring 80 relative to the pocket 90. This rotation is so small as to be almost undetectable by the user operating the louvers 24. The louver pin 82, which is fixed relative to the louver 24, is able to rotate relative to the pocket 88 about the pivot axis of the louver 24, even as the spring 80 is held against rotation by the pocket 88, but there is a frictional resistance between the spring 80 and the head 91 of the louver pin 82 opposing this rotation.

During operation, as the louver 24 is rotated in a clockwise direction as seen from FIG. 12, the friction between the spring 80 and the louver pin 82 causes the spring 80 to rotate with the louver 24 and louver pin 82, until the outside surface 84*b* of the first end 84 of the spring 80 impacts against the receptacle 94 of the pocket 88. At the same time, the second end 86 of the spring 80 continues rotating clockwise with the louver 24 and louver pin 82, causing the spring 80 to tighten onto the head 91 of the louver pin 82, increasing the frictional resistance between the spring 80 and the pin 82. Additional clockwise rotation of the louver 24 brings the inside surface 86*a* of the second end 86 of the spring 80 into contact with its receptacle 92. At this point, the spring 80 stops rotating, the frictional force between the spring 80 and the louver pin 82 reaches its maximum and thus stops increasing, and the user may continue to rotate the louver 24 by overcoming this higher level of frictional resistance. The angular displacement of the spring 80 from the time the first end 84 of the spring 80 contacts its receptacle 94 until the other end 86 of the spring 80 contacts its receptacle 92 is so small as to be almost undetectable by the user operating the louvers 24.

As in the case of the brake band mechanism described earlier, as soon as the user releases the louver 24 (or the tilt rod 20) the ends 84, 86 of the spring 80 are no longer pressing against the corresponding receptacles 92, 94, and the frictional resistance between the spring 80 and the louver pin 82 goes back to its original level, which should be sufficient to keep the louvers 24 in place. However, should the moment arm, due to the weight of the tilt rod 20 at its connection point to the louver 24, act so as to close the louvers 24, the same reaction as was described above caused by the user, takes place. Namely, the outside surface 84*b* of the spring 80 impacts against its receptacle 94, with a resulting increase in the frictional resistance between the spring 80 and the louver pin 82, which counters the unwanted rotation of the louvers 24. A similar function occurs when the louver 24 is rotated in the opposite direction, again increasing the friction as the louver begins to rotate.

While several embodiments of the present invention have been shown and described, it is not practical to describe all the possible variations and combinations that could be made within the scope of the present invention. It will be obvious to those skilled in the art that modifications may be made to the embodiments described above without departing from the scope of the invention as claimed.

What is claimed is:

1. A brake arrangement, comprising:

a shutter frame;

at least one louver having left and right ends and mounted in said shutter frame for rotation about a pivot axis;

at least one louver mounting pin mounted along the pivot axis of the louver and projecting out one of said ends of said louver, wherein said mounting pin rotates with said louver;

a receptacle on said shutter frame which receives said projecting louver mounting pin; and a band brake mounted over said pin and inside said receptacle, said band brake selectively applying a radially inwardly directed braking force against said louver mounting pin, said band brake having first and second ends, wherein at least one of said first and second ends of said band brake rotates with said mounting pin.

2. A brake arrangement as recited in claim 1, wherein said receptacle defines a stop for stopping the rotation of the at least one of said brake ends so as to increase frictional resistance to rotation of said mounting pin as said mounting pin begins to rotate.

3. A brake arrangement as recited in claim 2, wherein said receptacle further defines a second stop for stopping rotation of the other of said brake ends.

4. A brake arrangement as recited in claim 3, wherein said second stop for stopping the rotation of the other of said brake ends limits said increase of frictional resistance to rotation between said band brake and said mounting pin.

5. A brake arrangement as recited in claim 2, wherein said band brake is a coil spring which compresses radially inwardly against the pin and wherein said first and second brake ends project outwardly.

6. A brake arrangement, comprising:

a shutter frame;

a plurality of louvers pivotably mounted for rotation inside said frame, each of said louvers defining an axis of rotation and being pivotable about its respective axis of rotation; and means for generating progressively increasing resistance to the rotation of said louvers in response to said rotation of said louvers about their respective axes, said means selectively rotating with at least one of said louvers and applying a radially inwardly directed friction force to resist the rotation of the louvers, wherein said force progressively increases in response to the rotation of the louvers.

7. A brake arrangement as recited in claim 6, wherein each of said louvers includes left and right outwardly projecting mounting pins, which define said respective axis of rotation; and wherein said means for generating progressively increasing resistance to said rotation includes at least one band brake mounted on the shutter frame, surrounding a respective one of said mounting pins, and applying a radially inwardly-directed force to resist the rotation of said respective mounting pin.

8. A brake arrangement as recited in claim 7, wherein said band brake has at least one end and said shutter frame defines a receptacle having a stop which stops said one end from rotation with said respective mounting pin as said band brake begins to rotate with its respective mounting pin, causing said increase in said inwardly-directed force.

9. A brake arrangement as recited in claim 8, wherein said band brake has a second end, and said receptacle has a second stop, which stops rotation of said second end.

10. A brake arrangement as recited in claim 6, and further comprising means for limiting said progressive increase in resistance to a set maximum, wherein a user can still rotate said louvers by overcoming said maximum resistance.

11. A brake arrangement, comprising:

a shutter frame;

a plurality of louvers pivotably mounted for rotation inside said frame, each of said louvers defining an axis of rotation and being pivotable about its respective axis of rotation;

a pin which rotates with at least one of said louvers; and means for generating progressively increasing resistance to the rotation of said louvers in response to said rotation of said louvers about their respective axes in both forward and backward directions; said means engaging said pin along an arc of at least 180 degrees.

12. A brake arrangement as recited in claim 11, and further comprising means for limiting said progressive increase in resistance to a set maximum, wherein a user can still rotate said louvers by overcoming said maximum resistance.

* * * * *